United States Patent [19]

Weinar

[11] 4,117,644

[45] Oct. 3, 1978

[54] WALLBOARD FASTENER

[76] Inventor: Roger Neil Weinar, 168 W. Woodside Ave., Buffalo, N.Y. 14220

[21] Appl. No.: 736,425

[22] Filed: Oct. 28, 1976

[51] Int. Cl.[2] ..... E04B 1/38

[52] U.S. Cl. ..... 52/714; 52/363; 52/483; 52/509; 52/DIG. 6

[58] Field of Search ..... 52/489, 494, 363, 481, 52/281, 357, 483, 359, 498, 509, 407, DIG. 6, 714; 50/360

[56] References Cited

U.S. PATENT DOCUMENTS

| | | | |
|---|---|---|---|
| 1,052,670 | 2/1913 | La Francis | 52/714 X |
| 2,281,519 | 4/1942 | Faber | 52/489 X |
| 2,325,766 | 8/1943 | Gisondi | 52/DIG. 6 |
| 2,351,525 | 6/1944 | Leary | 52/DIG. 6 |
| 2,568,490 | 9/1951 | Dunham et al. | 52/489 |
| 2,591,361 | 4/1952 | Knott | 52/489 |
| 2,851,740 | 9/1958 | Baker | 52/489 X |
| 2,900,677 | 8/1959 | Yetter | 52/489 X |
| 2,924,963 | 2/1960 | Taylor et al. | 52/509 |
| 3,047,985 | 8/1962 | Murphy | 52/363 X |
| 3,187,389 | 6/1965 | Anderson | 52/489 |
| 3,308,590 | 3/1967 | Ettore et al. | 52/714 X |
| 3,862,530 | 1/1975 | Martine | 52/489 X |

FOREIGN PATENT DOCUMENTS

| | | | |
|---|---|---|---|
| 543,324 | 7/1957 | Canada | 52/714 |
| 1,362,162 | 4/1964 | France | 52/714 |

*Primary Examiner*—Alfred C. Perham
*Assistant Examiner*—Farber
*Attorney, Agent, or Firm*—Raymond F. Kramer

[57] ABSTRACT

Mechanically fastened appended tabs invisibly secure common edge-abutting wallboard panels to common wood or metal framing members. The fastener appendants are spaced apart tabs extending from the back of and exposed beyond the vertical edges of the wallboard panels so as to be conveniently screw fastened. When screw fastened to common wall framing members, the appended tabs secure the wallboard panels slightly off the framing member front surface to permit offset appendant tabs of abutting wallboard panels to slide between the fastened wallboard panels and the framing members and be engaged by the fastened wallboard panels in a tongue and groove relationship.

7 Claims, 6 Drawing Figures

WALLBOARD FASTENER

BACKGROUND OF THE INVENTION

This invention relates to conventional wallboard construction and the common practice of supporting prefinished wallboard panels on ordinary framing members, such as wood or metal studs and furring runners. Prefinished wallboard panels are available from many sources in a wide variety of colors and textures, the most common being the vinyl surfaced gypsum drywall panels. Various methods are used to secure these prefinished panels to ordinary framing members, a preferred practice is to secure each sheet perimeter with self-drilling screw fasteners. This method holds the panels securely but requires a decorative cover or batten strip to conceal the unsightly screw heads along the exposed panel joints. A most aesthetically pleasing but more difficult construction method utilizes an adhesive to invisibly secure the wallboard panels to ordinary wood or metal framing members. This method eliminates the unsightly batten strips but elaborate bracing devices are required to temporarily secure the panels while the adhesive cures. The adhesive method is desirable for the unobstructed joint surface appearance, but the installation is more labor intensive and the panels are difficult to remove without damage.

Many so called "movable" or "demountable" partition systems are available which utilize prefinished wallboard panels modified with various fastening devices, but all of these systems require unique or specially manufactured framing members of more or less elaborate configuration. These special, single purpose framing members are not as readily available as competitively priced ordinary wood or metal studs and furring and expensive special inventories are required for installation and maintenance of these special systems.

SUMMARY OF THE INVENTION

In accordance with the present invention there are provided wallboard fasteners useful for holding a first wallboard panel to a framing member at an end thereof and for joining to a second wallboard panel to be installed coplanar with and having an end thereof abutting the held end of the first panel so that parts of said fasteners, on installation of the second wallboard, contact the first panel, to which said fasteners are not joined, and prevent transverse movements of the second panel. Such fasteners comprise single pieces of sheet metal each having a substantially flat plate portion, a tongue portion extending from the plate portion and coplanar therewith, a pair of web portions, one on each side of the tongue portion and each extending at a right angle from said plate portion and an impaling flange portion extending from each web portion in the same direction essentially parallel to and overlying said plate portion and opposite to the direction in which the tongue extends so that the plate portion may contact the surface of the wallboard panel while the impaling flange portion is impaling said panel at an edge thereof. Said fasteners include a walled depressed area in the plate and tongue portions with a longitudinal slot in the tongue portion, the depression being in the direction opposite to that in which the webs extend. The fasteners are free of impaling portions extending in the direction of the tongue portion and are free of webs extending beyond the depression from the tongue and from the plate portions in the direction the depression extends from such portions. In preferred embodiments of such fasteners the depressed area in the plate and tongue portions is of such a depth as to allow the head of a mounting screw passing through the slot in said depressed area to be below the surface of the tongue portion of the fastener and the depressed area has a substantially flat bottom and terminates short of the end of the tongue portion so as to facilitate insertion of fasteners impaled on a second wallboard panel behind a mounted first wallboard panel as the panels are assembled on a wall.

It is an object of the invention to provide a mechanical fastener appendant which will invisibly secure wallboard panels to ordinary wood or metal framing members.

A particular object of this invention is to provide a building structure of the type described wherein fastener appendants coengageably secure wallboard panels along abutting joints in a tongue and groove relationship.

A further object of the invention is to provide a building structure of the type described wherein the wallboard panels are removably attached to the supporting framing members.

Yet another object of the invention is to provide mechanical fastener appendants that may be joined to common wallboard panels just prior to installation.

Further objects and advantages of the invention will be brought out in the drawings and detailed description, wherein the purpose is to disclose a preferred embodiment of the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENTS

Figure 1:
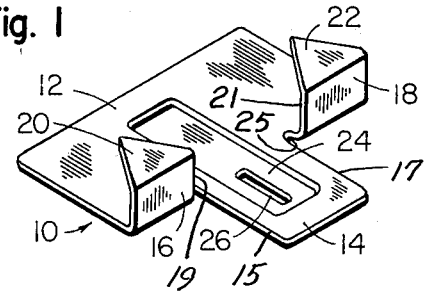
FIG. 1 is an isometric view of a preferred configuration of an impaling fastener appendant.

Referring to FIG. 1, an impaling fastener appendant 10 is shown formed of a unitary integral sheet of metal; such as steel. The appendant 10 is comprised of a plate portion 12, a centered tongue portion 14, a pair of discrete web portions 16 and 18, each with a wallboard impaling terminal penetrant portion 20 and 22 respectively. A longitudinally axially located flat bottomed and walled depressed area or indentation 24 is struck across plate portion 12 and tongue portion 14 to (a) act as a stiffening rib, (b) increase the effective thickness of the tongue 14 and the plate 12 portions and (c) provide a well for the head of a fastener such as a screw or nail. A longitudinally axially located slot 26 or a hole may be provided in this depressed or indented portion 24 of the tongue 14 to facilitate convenient mechanical fastening. Sides 15 and 17 of tongue 14 are spaced apart from sides 19 and 21 of web portions 16 and 18, respectively so that clearance openings 23 and 25 between the webs and the tongue are provided.

Figure 2:
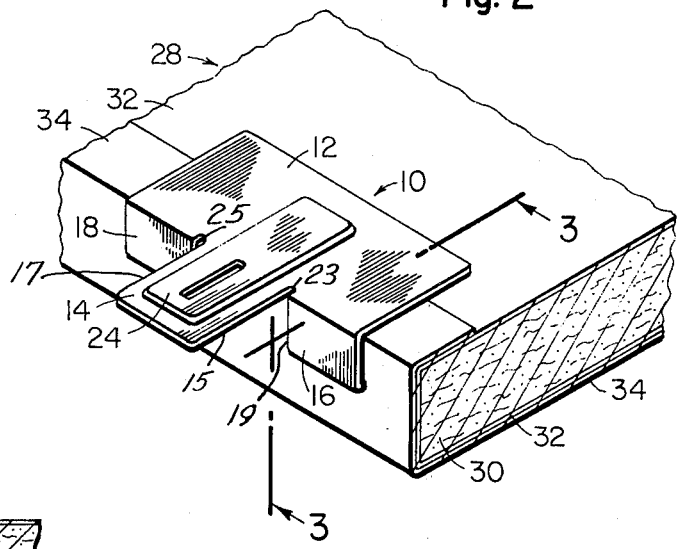
FIG. 2 is a fragmentary isometric view of a common wallboard panel with an impaling fastener appendant joined thereto.
Figure 3:
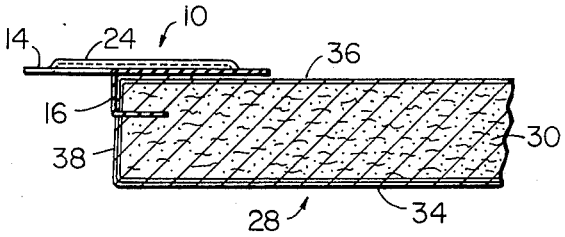
FIG. 3 is a cross-sectional view taken along the plane 3—3 of FIG. 2 viewed in the direction of the arrows.

In FIGS. 2 and 3 the fastener appendant 10 has been installed by impalement on common wallboard panel 28. These wallboard panels are often comprised of a semi-rigid center composition 30, such as gypsum, an outer wrap 32, such as paper and a decorative surface cover 34, such as embossed vinyl plastic. In practice, the appendants 10 are installed by impalement on wallboard panels 28 by placing plate portion 12 in firm flat contact with the back surface 36 of wallboard panel 28, as shown in FIG. 3 to cause pointed penetrants 20 and 22 to impale wallboard panel 28 at the approximate midpoint of its end surface 38. The appendant penetration is easily accomplished by striking web portions 16 and 18 alternately.

Figure 4:
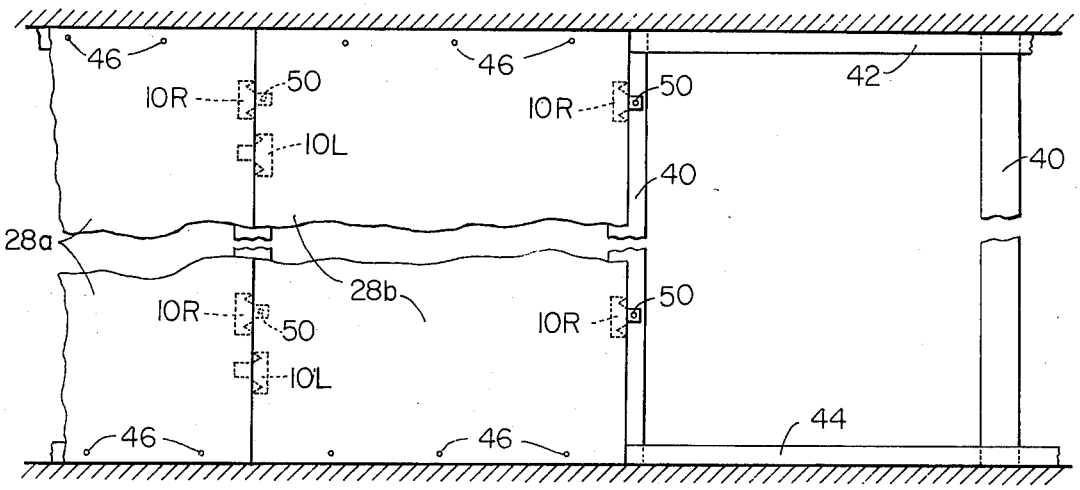
FIG. 4 is a partial elevational view of a wall or partition assembly utilizing the features of the present invention and having some of the wallboard panels removed to reveal the exposed portion of the fastened appendant tabs.

For proper appendant location on each wallboard panel, it has been found to be convenient to pencil or scribe spaced lines on the back side of each wallboard panel along marginal edges at quarter points. This spaces the lines two, four, and six feet distant from the top end of a common eight foot high panel. The appendants are then installed by impalement slightly above the scribed lines on the left marginal edge, and the appendants are installed slightly below the scribed lines on the right marginal edge of each wallboard panel. This appendant layout is necessary to insure the by-pass of opposing appendants of abutting wallboard panels when vertically erected on the framing members as illustrated in FIG. 4, which illustrates a typical wall structure or partition of the type contemplated according to the broad concept of the invention. The wall structure comprises common sheet metal framing members, including laterally spaced apart stud members 40 which have their upper and lower ends frictionally retained in rigid channel shaped runners 42 and 44, mounted on ceiling and floor, respectively, with open channel sides in confronting relationship to receive the respective ends of the studs.

The wallboard panel erection of the partition in FIG. 4 was begun in a left corner (not shown) and is proceeding sequentially to the right. Wallboard panels **28*a* and 28*b* have been secured to upper and lower channels 42 and 44 by common drywall screws 46. The exposed screw heads are later concealed across the top marginal edge with a common ceiling trim runner (not shown) and concealed along the bottom marginal edge with a common baseboard trim runner (not shown). Only the abutting vertical edges of the wallboard panels are secured with the fastener appendants of this invention. Appendant tabs 10R, installed along the right vertical marginal edges of wallboard panels 28*a* and 28*b* are secured to the vertical stud runners 40 by common sheet metal screws 50. Offset appendant tabs 10L impaled along the left vertical marginal edge of wallboard panel 28*b* are frictionally disposed behind the previously fastened abutting wallboard panel and between it and stud 40** in a tongue and groove relationship.

Figure 5:
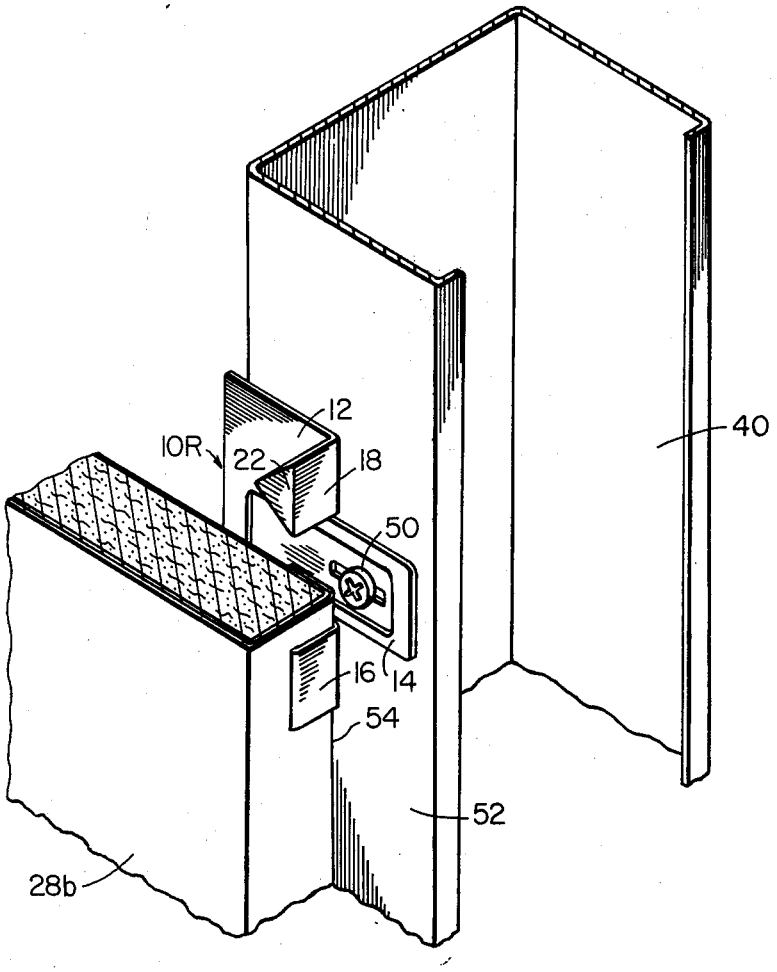
FIG. 5 is a partly cut-away isometric view showing a wallboard panel with the impaling appendant tab secured to a common metal stud framing member by an ordinary self-drilling screw fastener.
Figure 6:
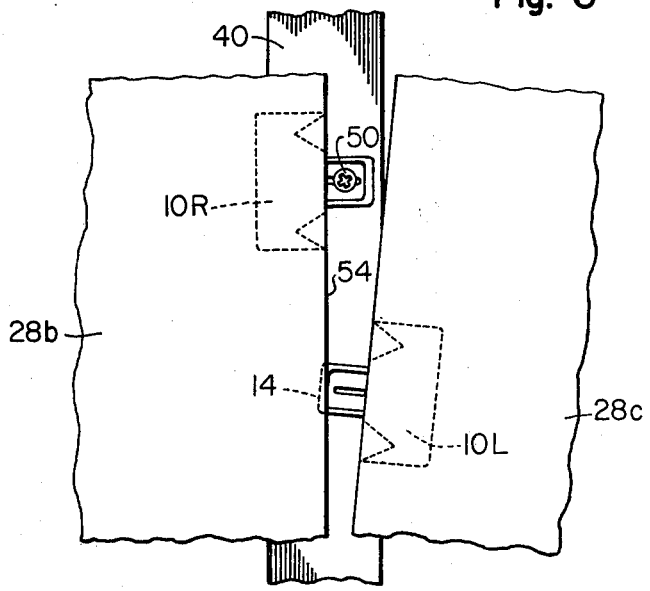
FIG. 6 is a partial elevational view of a wall assembly illustrating the sequential installation of the coengaged wallboard panels.

The sequence of the panel erection is better illustrated in FIGS. 5 and 6. In FIG. 5 the wallboard panel **28*b* is cut away to better display the fastener appendant 10R, which is secured to a common sheet metal stud 40 by a common self drilling screw 50. Wallboard panel 28*b* is rigidly held, slightly off the framing member front surface 52, creating a slot 54 or groove between the back surface of the wallboard panel 28*b* and stud 40, between the appendants 10R for convenient insertion of offset appendant tabs 10L of abutting wallboard panel 28*c*, as illustrated in FIG. 6**. It should be noted that the metal stud represents only one of the many common types of framing members and the use of the appendant fasteners of this invention is not limited to framing members of this configuration. On the contrary, a unique advantage of the screw or nail fastened appendant is its ability to work equally well on any flat surfaced wall framing members, wood or metal. While appendant fastener tabs installed by impalement on common wallboard panels at the job site give excellent results, it is obvious that the appendants of this invention could be attached at the wallboard manufacturing plant with an adhesive or other suitable means and transported with the panels to the job site.

Various other modifications may suggest themselves to those skilled in the art without departing from the spirit of my invention and hence, I do not wish to be restricted to the specific form shown or uses mentioned, except to the extent indicated in the appended claims.

What is claimed is:

1. Wallboard fasteners useful for holding a first wallboard panel to a framing member at an end thereof and for joining to a second wallboard panel to be installed coplanar with and having an end thereof abutting the held end of the first panel so that parts of said fasteners, on installation of the second wallboard, contact the first panel, to which said fasteners are not joined, and prevent transverse movements of the second panel, which fasteners are each of a single piece of sheet metal having a substantially flat plate portion, a tongue portion extending from the plate portion and coplanar therewith, a pair of web portions, one on each side of the tongue portion and each extending at a right angle from said plate portion and an impaling flange portion extending from each web portion in the same direction essentially parallel to and overlying said plate portion and opposite to the direction in which the tongue extends so that the plate portion may contact the surface of the wallboard panel while the impaling flange portion is impaling said panel at an edge thereof, said fasteners including a walled depressed area in the plate and tongue portions with a longitudinal slot in the tongue portion, the depression being in a direction opposite to that in which the webs extend, and said fasteners being free of impaling portions extending in the direction of the tongue portion and being free of webs extending beyond the depression from the tongue and from the plate portions in the direction the depression extends from such portions.

2. Wallboard fasteners according to claim 1, in each of which the depressed area in the plate and tongue portions is of such a depth as to allow the head of a mounting screw passing through the slot in said depressed area to be below the surface of the tongue portion of the fastener and in which said depressed area has a substantially flat bottom and terminates short of the end of the tongue portion so as to facilitate insertion of fasteners impaled on a second wallboard panel behind a mounted first wallboard panel as the panels are assembled on a wall.

3. Wallboard fasteners according to claim 1 wherein sides of the web portions near sides of the tongue portion are spaced away from said tongue portion.

4. Wallboard fasteners according to claim 2 wherein sides of the web portions near sides of the tongue portion are spaced away from said tongue portion.

5. Wallboard fasteners according to claim 4 wherein in each fastener the slot therein extends into the plate portion thereof.

6. Wallboard fasteners according to claim 1 which are of steel, each of which comprises a substantially rectangular flat plate portion, a substantially rectangular tongue portion coplanar with the plate portion and extending longitudinally axially from it, a longitudinally axially located flat bottomed depressed area in both plate and tongue portions and a longitudinally axially located slot opening therethrough in the tongue portion, and in which, between each of the webs and the plate portion there is a clearance opening.

7. Wallboard fasteners according to claim 2 which are of steel, each of which comprises a substantially rectangular flat plate portion, a substantially rectangular tongue portion coplanar with the plate portion and extending longitudinally axially from it, a longitudinally axially located flat bottomed depressed area in both plate and tongue portions and a longitudinally axially located slot opening therethrough in the tongue portion, and in which, between each of the webs and the plate portion there is a clearance opening.

* * * * *